US008192562B2

(12) United States Patent
Yoshihara

(10) Patent No.: US 8,192,562 B2
(45) Date of Patent: Jun. 5, 2012

(54) SPRING STEEL WIRE EXCELLENT IN FATIGUE CHARACTERISTIC AND WIRE DRAWABILITY

(75) Inventor: Nao Yoshihara, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 301 days.

(21) Appl. No.: 12/444,001

(22) PCT Filed: Oct. 30, 2007

(86) PCT No.: PCT/JP2007/071113

§ 371 (c)(1),
(2), (4) Date: Apr. 2, 2009

(87) PCT Pub. No.: WO2008/053884

PCT Pub. Date: May 8, 2008

(65) Prior Publication Data

US 2010/0034691 A1 Feb. 11, 2010

(30) Foreign Application Priority Data

Oct. 31, 2006 (JP) ..... 2006-296993

(51) Int. Cl.
*C22C 38/00* (2006.01)
*C22C 38/28* (2006.01)
*C22C 38/32* (2006.01)

(52) U.S. Cl. ..... 148/330; 420/105; 420/118; 420/121; 420/126; 420/127

(58) Field of Classification Search ..... 148/330, 148/333, 908; 420/117, 118, 121, 126
See application file for complete search history.

(56) References Cited

U.S. PATENT DOCUMENTS 4,889,567 A * 12/1989 Fujiwara et al. ..... 148/598
(Continued)

FOREIGN PATENT DOCUMENTS

EP 1 096 031 A2 5/2001
(Continued)

OTHER PUBLICATIONS

Office Action issued Apr. 7, 2011, in Korean Patent Application No. 10-2009-7008917 (with English-language translation).

(Continued)

*Primary Examiner* — Scott Kastler
*Assistant Examiner* — Vanessa Luk
(74) *Attorney, Agent, or Firm* — Oblon, Spivak, McClelland, Maier & Neustadt, L.L.P.

(57) ABSTRACT

An object of the preset invention is to provide a spring steel wire that: shows excellent wire drawability not only when it is used as a spring steel wire for cold-winding formed into a steel spring by applying quenching and tempering treatment after wiredrawing but also when it is used as a spring steel wire for cold-winding formed into a steel spring as it is wiredrawn; and secures a spring having an excellent fatigue characteristic after the spring steel wire is formed into the spring. The spring steel wire according to the present invention is a spring steel wire excellent in fatigue characteristic and wire drawability, wherein: the contents of C, Si, Mn, Cr, Ti, B, and other elements are specified; the contents (mass %) of B, Ti, and N satisfy the expression (1) below; the amount of solid solute B is in the range of 0.0005% to 0.0040%; the remainder in the spring steel wire is composed of Fe and unavoidable impurities; and the solid solute B concentrates at the grain boundaries of pearlite nodules, $$0.03 \leqq B/(Ti/3.43-N) \leqq 5.0 \quad (1).$$

15 Claims, 2 Drawing Sheets

U.S. PATENT DOCUMENTS

| | | | | |
|---|---|---|---|---|
| 6,322,641 | B1 | 11/2001 | Makii et al. | |
| 6,406,565 | B1 | 6/2002 | Hashimura et al. | |
| 6,602,359 | B1 * | 8/2003 | Ochi et al. | 148/330 |
| 7,074,282 | B2 | 7/2006 | Ibaraki et al. | |
| 2005/0173028 | A1 | 8/2005 | Suda et al. | |
| 2009/0025832 | A1 | 1/2009 | Yoshihara | |

FOREIGN PATENT DOCUMENTS

| | | | |
|---|---|---|---|
| EP | 1 096 031 | A3 | 5/2001 |
| EP | 1 577 411 | A1 | 9/2005 |
| JP | 56-44747 | | 4/1981 |
| JP | 2-57637 | | 2/1990 |
| JP | 11 29839 | | 2/1999 |
| JP | 2000 313937 | | 11/2000 |
| JP | 2000 355736 | | 12/2000 |
| JP | 2001-181794 | | 7/2001 |
| JP | 2001-240941 | | 9/2001 |
| JP | 2002 180200 | | 6/2002 |
| JP | 2004 2994 | | 1/2004 |
| KR | 2000-0071463 | | 11/2000 |

OTHER PUBLICATIONS

Extended European Search Report issued Mar. 22, 2011, in European Patent Application No. 07830847.5.

* cited by examiner

SPRING STEEL WIRE EXCELLENT IN FATIGUE CHARACTERISTIC AND WIRE DRAWABILITY

TECHNICAL FIELD

The present invention relates to a spring steel wire excellent in fatigue characteristic and wire drawability. More specifically, the preset invention relates to a spring steel wire that: shows excellent wire drawability not only when it is used as a spring steel wire for cold-winding formed into a steel spring by applying quenching and tempering treatment after wiredrawing but also when it is used as a spring steel wire for cold-winding formed into a steel spring as it is wiredrawn; and secures a spring having an excellent fatigue characteristic after the spring steel wire is formed into a spring.

BACKGROUND ART

With the trend of weight reduction and higher stress of an automobile and the like, a higher stress resistance is required of a valve spring, a clutch spring, and a suspension spring used for an engine, a clutch, and a suspension, thus the stress loaded on a spring tends to increase more and more, and hence a spring excellent in fatigue strength is desired.

In recent years, most of valve springs and suspension springs: use quenched and tempered spring steel wires called oil-tempered wires as the materials; and are produced by being wound into the shape of a spring at ordinary temperature.

Such an oil-tempered wire: has advantages that it can easily obtain a high strength and is excellent in fatigue characteristic and sag resistance since the metallographic structure thereof is a tempered martensite structure; but has the disadvantage that large-scale equipment and treatment cost are required for heat treatment including quenching and tempering. To cope with that, a steel wire of a type that is formed into the shape of a spring by applying cold-winding as it is wiredrawn is known. For example, a piano wire type V is stipulated particularly as a steel wire for a valve spring and a spring conforming to the valve spring among the piano wires in JIS standard (JIS G3522).

In the case of a spring produced not by the application of heat treatment including quenching and tempering as stated above but by cold-drawing (this sort of spring is hereunder referred to as "hard-drawn spring" occasionally), heat treatment is not required and hence the production cost can be reduced. To the contrary, a spring steel wire produced by drawing a steel wire rod having a ferrite/pearlite structure or a pearlite structure without the application of heat treatment has drawbacks such as a low fatigue characteristic and low sag resistance. With such a steel wire rod being used as the raw material, a steel spring having performance satisfying increasingly sophisticated recent requirements is hardly obtained.

With regard to a hard-drawn spring that can be produced at a low cost too, various studies have been done with the aim of obtaining spring performance of a higher level and the present applicants have proposed a technology disclosed in JP-A No. 2002-180200 (Patent document 1). In Patent document 1, a high strength, for example a tensile strength of 1,890 MPa or higher in the case of a wire diameter of 3.5 mm, is obtained and excellent sag resistance is secured by stipulating a pearlite fraction in a hard-drawn spring steel wire in relation to a carbon content and further fining a pearlite nodule size by containing V as an essential element.

With the increase of strength merely by the increase of a carbon content however, the deterioration of wire drawability and toughness cannot be avoided and the increase of the pearlite fraction causes industrial productivity to be limited. Moreover, since the hardenability of a steel increases when V is added, the wire speed has to be reduced at a patenting process required before wiredrawing in order to obtain a pearlite structure and that causes productivity to lower and thus production cost to increase.

Meanwhile, as another technology, the present applicants: have developed a steel wire having improved longitudinal crack resistance by forming pearlite as the main phase and reducing the ferrite area ratio at the surface part as a high-carbon steel material used for the production of a fine wire such as a steel cord or a wire rope; and have disclosed the technology in JP-A No. 2000-355736 (Patent document 2).

The steel wire resembles a steel wire according to the present invention in terms of (1) the main phase is composed of pearlite and thereby the ferrite area ratio is suppressed at the surface part, (2) a B content is stipulated in relation to a Ti content and a N content in order to suppress the generated ferrite amount at the surface part, and (3) not only a total B amount (the same as a B amount in steel) but also a solid solute B amount is controlled.

The technology disclosed in Patent document 2 however is a steel material that is intended to be applied to an ultrafine wire comprising a high-carbon steel wire having a relatively high carbon content such as a steel cord, a bead wire, or a wire rope and is aimed at improving the longitudinal crack resistance required for heavy wiredrawing and the applications and the required characteristics thereof are different from the present invention that is intended to be applied to a spring steel wire used for a valve spring and a suspension spring comprising medium-carbon steel and is aimed at improving a spring fatigue characteristic and wire drawability.

Moreover, the technology focuses only on wiredrawing limit, does not refer to a fatigue characteristic, and is an invention different in kind from the applied present invention on the point that nothing has been pursued from the viewpoints of suppression of the segregation of impurity elements (phosphorus and other elements) by the segregation of free B (solid solute B) to pearlite nodules, the accompanying wire drawability, and improvement of strength and ductility, as those will be described later in detail.

Further, according to the confirmation by the present inventors, the steel wire disclosed in Patent document 2 is a very useful steel grade on the point that the steel wire has a high strength of a 4,000 MPa level in the case of a small diameter but the steel wire has not necessarily been satisfactory as a spring steel wire.

DISCLOSURE OF THE INVENTION

The present invention has been studied while attention is paid on the above situation and an object thereof is to provide a spring steel wire that can improve a fatigue characteristic and enhance high-strength and high-stress while wire drawability after hot rolling and wire drawability after patenting treatment are improved. More specifically, an object of the present invention is to provide a spring steel wire that can improve the fatigue characteristic and enhance the strength of the spring steel wire itself by reducing to the utmost the ferrite fraction in order to increase the pearlite fraction and secure a steel spring having excellent wire drawability by devising the existence state of solid solute B.

A spring steel wire according to the present invention, which can solve the above problems, is characterized in that: the spring steel wire contains C: 0.50%-0.70% (% means mass % in the case of a chemical component, the same is applied hereunder),
Si: 1.0%-2.5%,
Mn: 0.5%-1.5%,
Cr: 0.5%-1.5%,
Ti: 0.005%-0.10%,
B: 0.0010%-0.0050%,
N: 0.005% or less,
P: 0.015% or less,
S: 0.015% or less,
Al: 0.03% or less, and
O: 0.0015% or less;

the contents (mass %) of B, Ti, and N satisfy the expression (1) below;

the amount of solid solute B is in the range of 0.0005% to 0.0040%;

the remainder in the spring steel wire is composed of Fe and unavoidable impurities;

when the diameter of the steel wire is represented by D, the ferrite fraction at a position ¼ D in depth from the surface is 1 area % or less; and the solid solute B concentrates at the grain boundaries of pearlite nodules, $$0.03 \leqq B/(Ti/3.43-N) \leqq 5.0 \quad (1).$$

In a spring steel wire used in the present invention, it is also effective to further enhance the improvement by further containing, as additional elements, at least one element selected from among the group of V: 0.07%-0.4%,
Nb: 0.01%-0.1%,
Mo: 0.01%-0.5%,
Ni: 0.05%-0.8%, and
Cu: 0.01%-0.7%.

Then a steel spring produced by using the above spring steel wire according to the present invention has an excellent fatigue characteristic and the spring is also included in the technological scope of the present invention.

The present invention makes it possible to provide a spring steel wire that is excellent in strength and wire drawability and exhibits an excellent fatigue characteristic after spring forming by using a medium-carbon steel having a C content in the range of 0.50% to 0.70% and Si, Mn, Cr, and others the contents of which are specified, making an appropriate amount of B and an appropriate amount of solid solute B contain, thereby inhibiting the early precipitated ferrite from forming, when the diameter of the steel wire is represented by D, controlling the ferrite fraction at a position ¼ D in depth from the surface to 1 area % or less, making the solid solute B concentrate and exist at the crystal grain boundaries of pearlite nodules, inhibiting P and other elements from segregating at the crystal grain boundaries, and thereby hindering embrittlement.

BEST MODE FOR CARRYING OUT THE INVENTION

Figure 1:
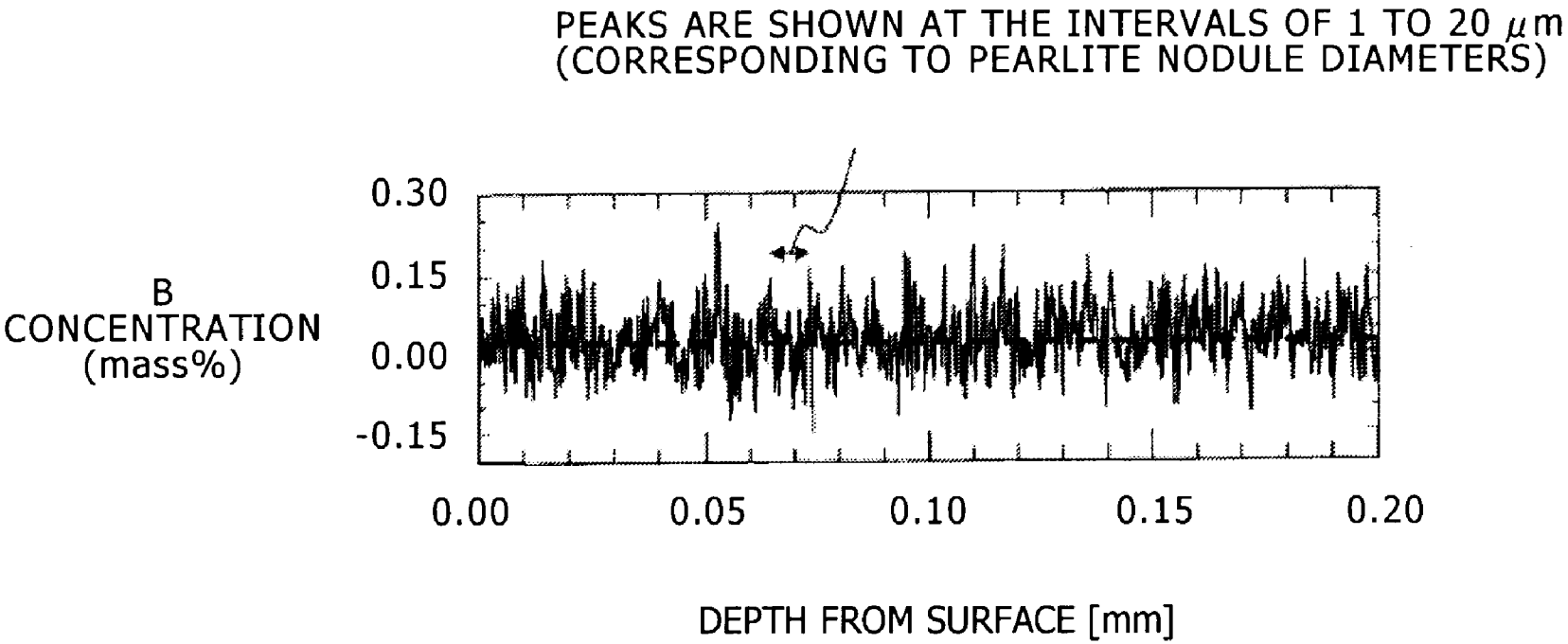
FIG. 1 is a chart showing the state of concentration of B to pearlite nodule crystal grain boundaries obtained by EPMA linear quantitative analysis of a spring steel wire according to the present invention.

On the basis of findings by the present inventors, they have convinced that a pearlite fraction has limitation by itself in consideration of industrial productivity even when a C amount is increased with the aim of the strengthening of a spring steel wire, and hence breakage occurs because early precipitated ferrite existing as the second phase structure acts as the starting point during wiredrawing, fatigue fracture occurs during the use of a spring, and those cause the fatigue life of a spring to deteriorate or fluctuate. It is estimated that the formation of the early precipitated ferrite is caused partially by decarburization occurring in the process of hot rolling or heat treatment (patenting) before wiredrawing.

On the basis of the findings, the present inventors: have confirmed that, by inhibiting early precipitated ferrite that is estimated to cause fatigue life to fluctuate at a surface part from forming, it is possible to improve wire drawability and stabilize the fatigue characteristic of a spring while the balance between high strength and toughness is maintained; and have attained the present invention. Embodiments according to the present invention are hereunder explained.

Features of the present invention are summarized as follows.

(1) Early precipitated ferrite is inhibited from forming by adding an appropriate amount of B in a medium-carbon steel.

(2) Early precipitated ferrite is inhibited from forming by adding Ti, thereby capturing N unavoidably included in a steel, and making B exist as free B (solid solute B).

(3) Further, wire drawability, strength, fatigue strength, and ductility are improved by concentrating and precipitating free B at the grain boundaries of pearlite nodules, thereby inhibiting impurity elements such as P from segregating at the grain boundaries of pearlite nodules, and thus preventing a steel from embrittling.

(4) The strength of a drawn wire is enhanced, spring fatigue life is prolonged, and the fluctuation thereof is reduced by reducing an early precipitated ferrite fraction.

That is, in order to make use of the features of the present invention, ferrite is inhibited from forming by adding B into a steel as an alloy element and making B in the state of solid solute B by adding an appropriate amount of Ti, P and other elements are inhibited from segregating and embrittlement is prevented from occurring by further making the solid solute B exist at appropriate locations in a concentrated manner, and thereby excellent wire drawability and fatigue characteristic are obtained stably.

With regard to the component composition of a steel material stipulated in the present invention, the contents and the reasons of limiting the contents on each of the elements are clarified hereunder.

C: 0.50%-0.70%

C is an element useful for enhancing the tensile strength of a drawn wire and securing a fatigue characteristic and sag resistance and is contained usually by about 0.8% in the case of an ordinary piano wire. In a spring steel wire of a high strength as the object of the present invention however, if a C content exceeds 0.70%, defect susceptibility increases, cracks propagate easily from surface defects and inclusions, and fatigue life deteriorates considerably and hence the upper limit of the C content is set at 0.70%. In contrast, if a C content is too small, a tensile strength necessary for a high stress spring is not secured, the amount of early precipitated ferrite increases, and the deterioration of fatigue life is not inhibited, and hence C has to be contained at least by 0.50%. The C content is preferably in the range of 0.55% to 0.68% and yet preferably in the range of 0.60% to 0.65%.

Si: 1.0%-2.5%

Si is an element that contributes to the enhancement of strength as a solid solution hardening element and the improvement of a fatigue characteristic and sag resistance.

Further, heat treatment (annealing) is applied at 400° C. or higher in order to relief stress after coiling in a spring forming process and, on the occasion, Si has the function of enhancing softening resistance. Si has to be contained at least by 1.0% or more in order to exhibit the functions effectively. If Si is excessive however, it promotes surface decarburization and deteriorates a fatigue characteristic, and hence Si has to be controlled at most to 2.5% or less. A preferable lower limit of the Si content is 1.6% and a preferable upper limit thereof is 2.2%.

Mn: 0.5%-1.5%

Mn makes pearlite composing the main phase dense and orderly and is an element indispensable for improving a fatigue characteristic. The effects are exhibited effectively when Mn is contained by 0.5% or more. If Mn is excessive however, a bainite structure tends to form during hot rolling and patenting treatment and wire drawability is hindered, and hence the upper limit of Mn is set at 1.5%. A preferable lower limit of the Mn content is 0.70% and a preferable upper limit thereof is 1.0%.

Cr: 0.5%-1.5%

Cr is an element indispensable for narrowing the lamellar intervals of pearlite, enhancing strength after patenting applied as heat treatment after hot rolling and before wire-drawing, and improving sag resistance and fatigue strength. In order to exhibit the effects effectively, Cr must be contained by 0.5% or more. If Cr is excessive however, the end of pearlite transformation is delayed, resultantly not only wire speed has to be lowered at patenting and productivity is hindered but also cementite is excessively strengthened and toughness and ductility deteriorate, and hence the upper limit of Cr is set at 1.5%. A preferable lower limit of the Cr content is 0.7% and a preferable upper limit thereof is 1.2%.

Ti: 0.005%-0.10%

Ti is added for the purpose of fixing N as TiN so that N unavoidably existing in steel may not bind to B in order to make B exist as free B. Further, Ti contributes to forming fine carbides (TiC), fractionizing pearlite nodules, and improving wire drawability and toughness. In order to exhibit the functions effectively, the lower limit of Ti is set at 0.005%. If Ti is added excessively however, an excessive amount of TiC is formed by redundant Ti, wired raw ability rather deteriorates by the precipitation hardening of lamellar ferrite, TiN itself coarsens, that causes fatigue fracture originated from inclusions to be induced, and hence the upper limit of Ti is set at 0.10%. Here, the lower limit of Ti should be decided in consideration of the contents of B and N stipulated by the expression (1) as it will be described later in detail. A preferable lower limit of the Ti amount is 0.01%.

B (Boron): 0.0010%-0.0050%, and 0.0005%-0.0040% as Solid Solute B

B is an important element that is added in order to inhibit ferrite from forming at the surface part of a steel wire. Generally B acts effectively on the reduction of early precipitated ferrite since B segregates at prior austenitic grain boundaries in hypoeutectoid steel, lowers grain boundary energy, and lowers ferrite forming speed. Although it is generally thought that B eliminates the ferrite inhibition effect in eutectoid steel or hypereutectoid steel, in a steel grade wherein a C content at a surface part is estimated to lower due to decarburization, even in the case of a composition of eutectoid or hypereutectoid like the case of the present invention, it is estimated that B functions effectively as an early precipitated ferrite inhibitor element at the surface part.

The existence form of B in that case is generally called free B. The free B is solid solute B existing not as an inclusion but as an atom in steel. The solid solute B further inhibits impurity elements including P from segregating to the grain boundaries of pearlite nodules, enhances the strength of the pearlite nodules, enhances the strength of a spring steel wire, and also improves wire drawability. If B is less than 0.0010% and the solid solute B is less than 0.0005%, the aforementioned effects of B and solid solute B are insufficient. In contrast, if B is excessive, B compounds such as $Fe_{23}(CB)_6$ are formed, B existing as free B reduces, and B cannot contribute to the reduction of fluctuation of fatigue strength. Moreover, the B compounds such as $Fe_{23}(CB)_6$ tend to be coarse in many cases, act as the origin of fatigue fracture, and deteriorate fatigue strength. For that reason, B should be controlled to 0.0050% or less as a B amount and to 0.0040% or less as solid solute B. A referable B amount is in the range of 0.0020% to 0.0040% and a preferable solid solute B amount is in the range of 0.0010% to 0.0030%.

$$0.03 \leqq B/(Ti/3.43-N) \leqq 5.0 \quad (1)$$

The term (Ti/3.43−N) in the above expression (1) represents a redundant Ti amount in the case where N is fixed by Ti. If a value of B/(Ti/3.43−N) is less than 0.03, the redundant Ti amount is excessive to the B content and hence the deterioration of wire drawability is caused by the precipitation of TiC. In contrast, if a value of B/(Ti/3.43−N) exceeds 5.0, the redundant Ti content is too small in comparison with the B content and hence N is insufficiently fixed, the free B amount is too small, and satisfactory ferrite precipitation inhibiting function is not obtained. For the reason, the lower limit of B/(Ti/3.43−N) is set at 0.03 and the upper limit thereof is set at 5.0. The lower limit is preferably 0.10 and yet preferably 0.20, and the upper limit is preferably 4.0 and yet preferably 2.5.

Further in the present invention, in addition to the total B amount (B amount in steel) and the free B amount (solid solute B amount), the locations where the free B exists are extremely important in improving the wire drawability of a spring steel wire. That is, although it has been attempted to restrict a total B amount and a free B amount from the viewpoints of the strength and the workability of steel in the case of conventional steel grades including the steel described in Patent document 2, particularly in the case of a spring steel wire intended in the present invention however, nothing has been pursued from the viewpoint of the question that in what region of pearlite nodules solid solute B should exist in order to exhibit the best effect. On the contrary, the present inventors have continued study and have found that it is possible to obtain a spring steel wire exhibiting wire drawability of a high level stably by making solid solute B concentrate and exist at the crystal grain boundaries of pearlite nodules.

Here, "solid solute B concentrates and exists at the crystal grain boundaries of pearlite nodules" means that, when the concentration of solid solute B existing at the crystal grain boundaries of pearlite nodules is measured by the measurement method described in the after-mentioned section in Examples, the amount of the solid solute B existing at the crystal grain boundaries (in particular, referred to as a segregated B amount occasionally) is 0.05% or more. The crystal grain boundaries of pearlite nodules exist at intervals of about 1 to 20 μm. As it will be shown in the after-mentioned Examples, when a segregated B amount is 0.05% or more, wire drawability improves. Preferably it is desirable that: a segregated B amount measured as stated above is 0.05% or more and; the condition that, when the average concentration of solid solute B in steel is regarded as 1, the concentration of the segregated B is 50 or more is satisfied.

The reason why wire drawability of a high level is obtained by making solid solute B concentrate and exist at the crystal grain boundaries of pearlite nodules as stated above is not completely clarified yet but the present inventors think as follows. That is, it is estimated that, when solid solute B is made to concentrate and exist at the crystal grain boundaries of pearlite nodules, the segregation of impurity elements (P and S in particular) that segregate at grain boundaries and violently deteriorate wire drawability is hindered by the existence of the solid solute B and the impurity elements are forced to exist in a dispersed manner in the crystal grains. As a result, not only wire drawability but also ductility after wiredrawing improves and forming processability improves remarkably when the steel wire is processed to a spring.

In view of the above situation, in the present invention, even the state of the existence of solid solute B in a steel wire is stipulated and the condition that the solid solute B concentrates and exists at the crystal grain boundaries of pearlite nodules is regarded as an essential requirement. Here, production conditions to obtain such a concentrated state of solid solute B are described later in detail.

N (Nitrogen): 0.005% or Less

In the present invention, as stated above, inevitably intruding N is fixed and solid solute B is secured by containing an appropriate amount of Ti. It is desirable to reduce N as far as possible in order to reduce a Ti addition amount. The promotion of excessive denitrification causes a steelmaking cost to increase however and hence the allowable limit of an N amount is set at 0.005% in consideration of real operability. The N amount is preferably 0.0035% or less and yet preferably 0.002% or less.

P (Phosphorus): 0.015% or Less

P segregates at prior austenite grain boundaries, embrittles the grain boundaries and deteriorates wire drawability, and hence P should be reduced as far as possible. The allowable limit is set at 0.015% in consideration of dephosphorization efficiency in real operation.

S (Sulfur): 0.015% or Less

S also segregates at prior austenite grain boundaries and embrittles the grain boundaries and deteriorates wire drawability, and hence S should be reduced as far as possible. The upper limit is set at 0.015% in consideration of desulfurization effect in real operation.

Al: 0.03% or Less

Al is contained as a deoxidizing agent added at steelmaking. If an Al amount is excessive however, Al turns to coarse nonmetallic inclusions and deteriorates fatigue strength, and hence Al should be controlled to 0.03% or less and preferably 0.005% or less.

O (Oxygen): 0.0015% or Less

O, if it is excessive, acts as the origin to cause coarse nonmetallic inclusions to be formed and deteriorates fatigue strength. Hence O should be controlled at most to 0.0015% or less and preferably 0.0010% or less.

The component composition of a steel material used in the present invention is as stated above and the remainder is substantially iron. Here, the term "substantially" means that the inclusion of trace elements intruding inevitably from steelmaking materials including scraps and at an ironmaking process, a steelmaking process, and moreover a steelmaking pretreatment process is allowed in the range not hindering the features of the present invention.

In the present invention, the steel may further contain, as additional elements, at least one element selected from among the group of V: 0.07%-0.4%, Nb: 0.01%-0.1%, Mo: 0.01%-0.5%, Ni: 0.05%-0.8%, and Cu: 0.01%-0.7%. Those elements may be contained individually or in combination of two or more elements. The selectable elements are hereunder explained in detail.

V: 0.07%-0.4%

V is a useful element that fractionizes pearlite nodules, improves wire drawability, and moreover contributes to the improvement of the toughness and the sag resistance of a spring. It is preferable to contain V by 0.07% or more in order to effectively exhibit the effects. If V is contained excessively however, arising drawbacks are that hardenability increases, a martensite structure and a bainite structure are formed after hot rolling, succeeding processes are hardly applicable, also the wire speed has to be reduced during patenting treatment, thus productivity lowers, moreover V carbides are formed, C that should be used as lamellar cementite is reduced, thereby the strength rather deteriorates, early precipitated ferrite is formed excessively, and ferrite decarburization is induced. Consequently, it is preferable to control a V amount at most to 0.4% or less. A preferable lower limit of the V content is 0.1% and a preferable upper limit thereof is 0.2%.

Nb: 0.01%-0.1%

Nb is a useful element that fractionizes pearlite nodules and improves wire drawability and the toughness and the sag resistance of a spring. It is preferable to contain Nb at least by 0.01% or more in order to effectively exhibit the effects. If Nb is contained excessively however, carbides form excessively, the C amount that should be used as lamellar cementite reduces, strength lowers, or early precipitated ferrite is caused to form excessively. Consequently, it is preferable to set the upper limit of Nb at 0.1%. A preferable lower limit of the Nb content is 0.02% and a preferable upper limit thereof is 0.05%.

Mo: 0.01%-0.5%

Mo is an element useful for enhancing hardenability and softening resistance and improving sag resistance. Such effects are effectively exhibited by containing Mo preferably by 0.01% or more. If Mo is contained excessively however, patenting time increases excessively and wire drawability deteriorates. Hence the upper limit of the Mo content is set at 0.5%.

Ni: 0.05%-0.8%

Ni has the functions of improving the ductility of cementite and enhancing wire drawability, and contributes also to the improvement of the wire drawability of a steel wire itself. Further, Ni has the function of inhibiting decarburization at a surface part during hot rolling and patenting treatment. It is preferable to contain Ni at least by 0.05% or more in order to effectively exhibit the effects. If Ni is added excessively however, hardenability increases, a martensite structure and a bainite structure are formed after hot rolling, succeeding processes are hardly applicable, also the wire speed has to be reduced during patenting treatment, and thus that causes production cost to increase. Consequently, it is preferable to set the upper limit of the Ni content at 0.8%. A preferable lower limit of the Ni content is 0.15%, a yet preferable lower limit thereof is 0.2%, and a preferable upper limit thereof is 0.7%.

Cu: 0.01%-0.7%

Cu is an element electrochemically nobler than Fe and effective in enhancing corrosion resistance, improving scale detachability during mechanical descaling, and preventing troubles such as die seizure. Further, Cu has also the functions of restricting ferrite decarburization during hot rolling and lowering early precipitated ferrite fraction at a surface part. It is preferable to contain Cu at least by 0.01% or more in order to effectively exhibit the functions. If Cu is added excessively however, it comes to be concerned to generate hot rolling cracks. Hence it is preferable to set the upper limit of the Cu content at 0.7%. A preferable lower limit of the Cu content is 0.2% and a preferable upper limit thereof is 0.5%.

Components in steel according to the present invention are explained above.

Meanwhile, in the surface side structure of a steel wire according to the present invention, the condition that, when the diameter of the steel wire is represented by D, the ferrite fraction is 1 area % or less in the observation of a cross section at a position ¼ D in depth from the surface is an essential requirement. Incidentally, as explained earlier, in a steel wire according to the present invention, early precipitated ferrite the formation of which is hardly completely avoided as the second phase structure causes fatigue life to shorten and to fluctuate. In the present invention therefore, it is important to reduce the fraction of the early precipitated ferrite to the utmost. Consequently in the present invention, as a standard of a ferrite fraction required for attaining the object, when the diameter of the steel wire is represented by D, the ferrite fraction is set at 1 area % or less in the observation of a cross section at a position ¼ D in depth from the surface.

Figure 2:
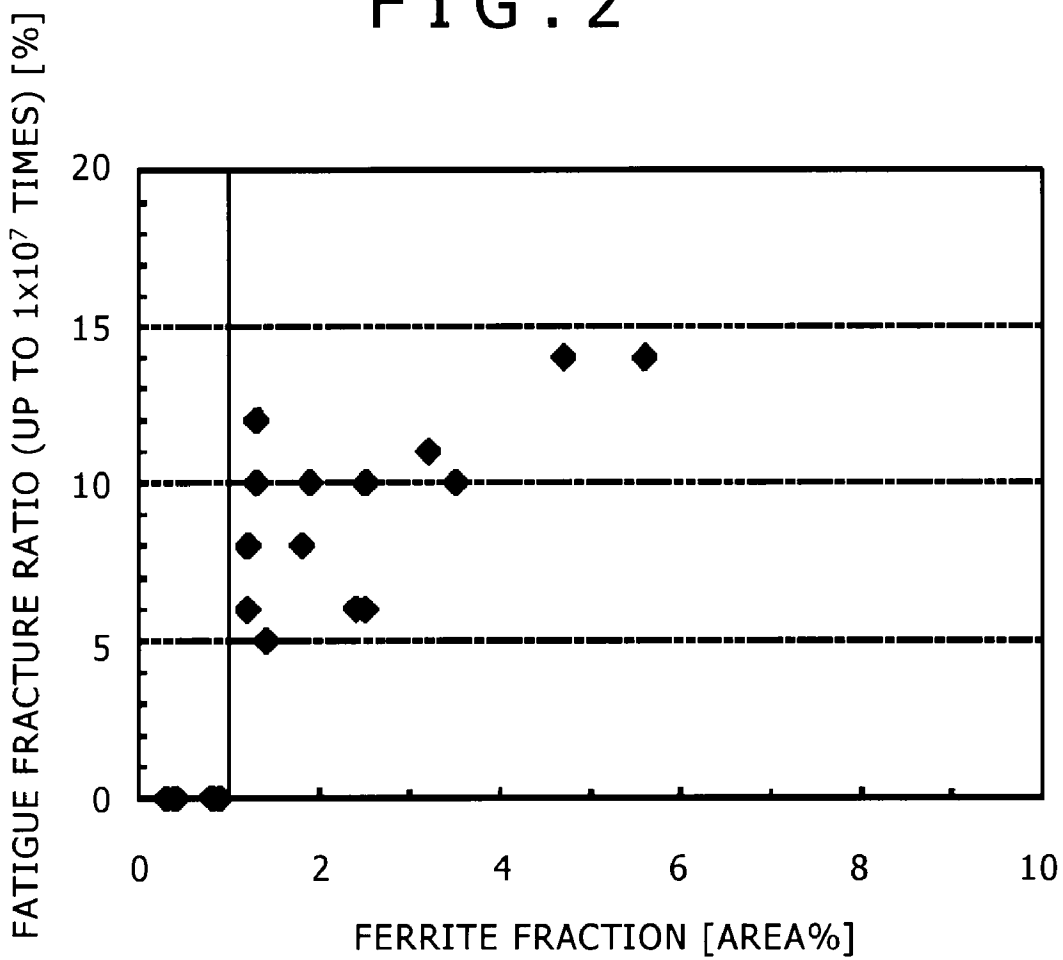
FIG. 2 is a graph showing the influence of a ferrite fraction on a fatigue fracture ratio.

Incidentally, if the ferrite fraction exceeds 1 area %, the fatigue fracture ratio of wires increases obviously as it will be clarified in the after-mentioned examples (FIG. 2) and it comes to be impossible to guarantee quality as a material for a spring. In the present invention here, not only an appropriate amount of B is contained but also the contents of Ti and N and further the relationship shown with the aforementioned expression (1) are stipulated in order to effectively exhibit the ferrite suppression effect of B as stated above.

Successively, desirable conditions in the production of a spring steel wire when a steel material having the aforementioned component composition is used are explained.

Firstly, when a steel material is produced by continuous casting, the cooling rate after casting is preferably 0.1° C./sec or higher and yet preferably 0.5° C./sec or higher. In this way, by increasing the cooling rate after casting, TiN inclusions formed in the steel are prevented to the utmost from coarsening.

Further, when a cast steel is hot-rolled, it is preferable to cool the steel material within 30 seconds in the temperature range from the placing temperature after finish-rolling (preferably 900° C. or higher as it will be stated later) to 850° C. in order to secure a solid solute B amount that is particularly important in the present invention. In the temperature range of lower than 850° C., the solid solute B in the steel material does not combine with N as long as the steel material is not subjected to constant temperature retention but naturally cooled by an ordinary method and B is maintained in the state of solid solution even after winding. The formation of ferrite is also inhibited in accordance with that.

Further, if the process to draw a wire as the steel material is hot-rolled and patenting treatment is not applied is taken into consideration, it is preferable to sufficiently lower the ferrite fraction at the state after rolling. In order to do so, it is preferable to control: the placing temperature after rolling to 900° C. or higher; and the cooling rate in the temperature range from the placing temperature to 700° C. preferably to 3° C./sec or higher and yet preferably to 5° C./sec or higher. More specifically, it is desirable to adopt an auxiliary cooling means such as air blow with a blower or mist spray.

At successively applied patenting treatment, after the steel material is retained (constant temperature retention) in the "temperature range higher than the $Ae_3$ transformation point (the upper limit of the temperature at which austenite and ferrite can coexist in a balanced manner)", it is preferable to rapidly cool the steel material, from the "temperature range higher than the $Ae_3$ transformation point" to the temperature range lower than the $Ae_1$ transformation point (the upper limit of the temperature at which ferrite and cementite can coexist in a balanced manner). It is preferable to use a heating medium having a high heat conductivity for the constant temperature retention. More specifically, it is preferable to: use a fluidizing tank wherein a particulate matter, such as zircon sand, having a large thermal capacity is used as the heat medium or a lead bath; and add a forced cooling process using air or mist during the time ranging from a reheating furnace for austenitization to the entry to a constant temperature retention furnace. The cooling rate on this occasion is preferably 3° C./sec and yet preferably 5° C./sec.

In the above patenting treatment, the purpose of heating and retaining the steel material in the "temperature range higher than the $Ae_3$ transformation point" is: to concentrate and segregate solid solute B at the crystal grain boundaries of pearlite nodules to the utmost; and to prevent P and the like as impurity elements from segregating at the crystal grain boundaries. Thus it is preferable to heat the steel material to a highest possible temperature. More specifically, the above "temperature range higher than the $Ae_3$ transformation point" is preferably the range of about 950° C. to 1,050° C. Incidentally, if the reheating temperature is lower than 950° C., the solid solute B amount is small and the solid solute B hardly concentrates at pearlite nodules. In contrast, if the reheating temperature rises excessively in excess of 1,050° C., pearlite nodules also coarsen in accordance with the coarsening of austenitic grains.

Further, if the retention time in the above "temperature range higher than the $Ae_3$ transformation point" is excessively long, decarburization at the steel wire surface part proceeds, pearlite nodules coarsen, and the solid solute B amount reduces, and hence B hardly concentrates to the pearlite nodules. Consequently, it is preferable to control the retention time in the above temperature range in the range of 30 to 180 seconds. Here, if the retention time is shorter than 30 seconds, dissolution of alloy elements is insufficient and strength is also insufficient. A preferable retention time is 50 to 150 seconds.

Here, when a spring steel wire according to the present invention is used as it is wiredrawn, it is preferable to stipulate the tensile strength (TS) of the spring steel wire with the expression (2) below in relation to the diameter (d; mm) of the spring steel wire and the area reduction ratio at the wiredrawing is preferably in the range of 75% to 93%. If the area reduction ratio is less than 75%, the orientation of the pearlite structure does not settle and a uniform wiredrawn structure is not obtained, and hence the fatigue life tends to fluctuate. In contrast, if the area reduction ratio exceeds 93%, the wiredrawing comes close to the limit and hence internal cracks occur, surface cracks are induced, and breakage may occur undesirably during the succeeding coiling of a spring or the usage of a spring.

$$-13.1d^3+160d^2-671d+2{,}800 \leqq TS \leqq -13.1d^3+160d^2-671d+3{,}200 \quad (2)$$

[In the expression, d means the diameter (mm) of a spring steel wire and $1.0 \leqq d \leqq 10.0$]

Description of Embodiments

The construction, functions, and effects of the present invention are hereunder explained more concretely in reference to examples, but the present invention is not limited by the examples below, it is also possible to add modifications appropriately to the present invention in the range conforming to the aforementioned and after-mentioned tenors, and all the modifications are also included in the technological scope of the present invention.

Examples

Bars 155 mm in square are obtained by melting the steels (steel grades A to K) having the chemical components shown in Table 1 in a small vacuum furnace, casting the steels, thereafter cooling the steels at the cooling rates shown in Table 2, and then hot-forging the steels. Successively, steel wire rods 9.0 mm in diameter are obtained by hot-rolling the bars under the rolling conditions shown in Table 2. Thereafter, wiredrawn materials (steel wires) are obtained by conditioning the wire rods to the diameter of 8.4 mm by applying skin shaving, thereafter applying patenting treatment under the conditions shown in Table 2, and wiredrawing the wire rods to the wire diameters shown in Table 2.

More specifically, at the patenting treatment process, as shown in Table 2, the austenitization heating temperature and the heating retention time are changed and the patenting time (transit time of wires in a lead bath) is also changed by steel grades by adjusting the cooling rate (wire speed). The lead bath temperature is set at 620° C. Further, wires are led to the lead bath after rapid cooling by applying forced-cooling by blowing high pressure air between the lead bath and the reheating furnace for austenitization.

Here, a continuous wiredrawing machine is used in the above wiredrawing, the area reduction ratio at each die excluding the final die is controlled in the range of 15% to 25%, and the area reduction ratio at the final die is set at 5%. The total area reduction ratios during wiredrawing are shown in Table 2. The wiredrawing rate is set at 200 m/min with the rate when a wire passes through the final die. Further, a cooling wiredrawing method of directly cooling a wire after patenting is adopted in order to prevent the rise of the wire temperature accompanying the wiredrawing.

Successively, the following features are measured for each of the drawn wires.

(Measurement of Tensile Strength)

Tensile strength is measured by straightening a drawn wire obtained as stated above and applying tensile test.

(Measurement of Total B Amount and Solid Solute B Amount)

A total B amount (B amount in steel) is measured by the ICP emission spectrometry stipulated in JIS K0116 (device: commercial name "ICPV-1017" made by Shimadzu Corporation).

Then a solid solute B amount is obtained as the difference between a total B amount and a precipitated B amount measured by the following method.

A B amount (precipitated B amount) is obtained by applying the curcumin absorptiometry (JIS G1227-1980) to the residue electro-extracted from a drawn wire. With regard to the electroextraction conditions, a 10% acetylacetone-1% tetramethylammonium chloride-methanol solution is used as the electrolyte, B is extracted with the electric current of 200 $A/m^2$ or lower, and a filter 0.1 μm in mesh is used for filtering the precipitated B.

(Measurement of Segregated B Amount)

A solid solute B amount (segregated B amount) concentrating and existing at the crystal grain boundaries of pearlite nodules is measured by the EPMA linear quantitative analysis method described below.

EPMA measuring device: commercial name "JXA-8900 RL" made by JEOL Ltd.

Test piece: prepared by embedding a drawn wire in resin, mirror-finishing the cross section perpendicular to the longitudinal direction of the drawn wire with an abrasive, and thereafter vapor-depositing osmium in order to retain electric conductivity.

Acceleration voltage: 15 kV

Irradiation current: 0.3 μA

Quantitative analysis: in the present example, a B amount concentrating by 0.01% or more is regarded as a "peak value", the "peak value" is measured at 300 positions, and the average is calculated as a "segregated B amount".

An example of an EPMA linear quantitative analysis chart of a spring steel wire according to the present invention is shown in FIG. 1. As shown in FIG. 1, in the example according to the present invention, the peaks of the B amount appear repeatedly at the intervals of 1 to 20 μm corresponding to the pearlite nodule diameters and it is confirmed that the solid solute B concentrates at the crystal grain boundaries of the pearlite nodules. Here, although the B amount shifts to the minus region in FIG. 1, this is fluctuation inevitable in the mechanism of the analysis device and the B amounts at the portions where the B amounts are minus are regarded as zero (0).

In the present example, the case where the segregated B amount measured as stated above is 0.05% or more is evaluated as "solid solute B concentrates at the grain boundaries of pearlite nodules". Moreover, the ratio of a thus measured "segregated B amount" to a "solid solute B amount" (segregated B amount/solid solute B amount) is computed and the case where the segregated B amount is 0.05% or more and also the above ratio is 50 or more is evaluated as "solid solute B concentrates more at the grain boundaries of pearlite nodules".

(Measurement of Ferrite Fraction)

A ferrite fraction is obtained by buffing a transverse cross section of a drawn wire, etching the cross section with a nitral corrosive liquid, thereafter photographing a ferrite structure at a surface part to obtain a SEM structural photograph with the commercial name "JXA-8900 RL" made by JEOL Ltd., and computing the area ratio of the ferrite part filled by the Photoshop that is software made by Adobe Systems Incorporated from the photograph image.

(Evaluation of Wire Drawability)

A case where, as well as no breakage occurs during wiredrawing at the aforementioned wiredrawing process, the frequency of twisting is 25 times or more at a twisting test is evaluated as "excellent in wire drawability" (accepted).

Successively, the spring characteristic test is carried out as follows and the fatigue limit characteristic is evaluated.

Spring Characteristic Test:

A spring is: formed at ordinary temperature with each of steel wire test pieces; and subjected to stress relief annealing (400° C.×20 min), bearing surface polishing, two-step shot peening (the spring is shot with round cut wire 0.6 mm in diameter and HRc60 in hardness at the coverage ratio of 95% or more for 15 minutes at a blasting speed of 80 m/sec and thereafter shot with round cut wire 0.1 mm in diameter and HRc65 in hardness at the coverage ratio of 100% or more for 20 minutes at a blasting speed of 200 m/sec), low temperature annealing (230° C.×min), and warm setting (200° C., $\tau_{max}$=1, 200 MPa equivalent). Shearing stress of 588±441 MPa is loaded on each of the springs, the breakage ratio obtained when 50 springs are loaded ten million cycles is used for the judgment. A case where the fatigue breakage ratio is zero is evaluated as "acceptable (excellent in fatigue characteristic)" and the other cases are evaluated as "unacceptable".

TABLE 1

| Steel grade | Chemical component (mass %) C | Si | Mn | Cr | Ni | V | Cu | Nb | Mo | Ti | B | N | P | S | Al | O | B/(Ti/3.43 − N) | $Ae_1$ point (° C.) | $Ae_3$ point (° C.) |
|---|---|---|---|---|---|---|---|---|---|---|---|---|---|---|---|---|---|---|---|
| A | 0.64 | 1.5 | 0.9 | 0.9 | — | — | — | — | — | 0.016 | 0.0020 | 0.0040 | 0.013 | 0.012 | 0.025 | 0.0012 | 3.01 | 764 | 790 |
| B | 0.65 | 1.9 | 0.9 | 0.7 | — | — | — | — | — | 0.075 | 0.0020 | 0.0048 | 0.005 | 0.009 | 0.005 | 0.0011 | 0.12 | 768 | 808 |
| C | 0.62 | 1.4 | 0.6 | 1.5 | — | — | — | — | — | 0.050 | 0.0030 | 0.0048 | 0.006 | 0.003 | 0.001 | 0.0010 | 0.31 | 779 | 792 |
| D | 0.6 | 1.9 | 0.9 | 1.0 | 0.25 | 0.12 | — | — | — | 0.010 | 0.0020 | 0.0020 | 0.003 | 0.004 | 0.010 | 0.0005 | 2.18 | 772 | 813 |
| E | 0.51 | 2.1 | 0.2 | 1.2 | 0.70 | — | 0.50 | — | — | 0.095 | 0.0033 | 0.0038 | 0.013 | 0.009 | 0.021 | 0.0006 | 0.14 | 785 | 838 |
| F | 0.68 | 2.4 | 1.2 | 0.6 | 0.80 | 0.22 | 0.61 | 0.04 | — | 0.018 | 0.0010 | 0.0015 | 0.012 | 0.013 | 0.015 | 0.0005 | 0.27 | 761 | 806 |
| G | 0.70 | 1.7 | 0.6 | 1.5 | — | — | — | — | 0.25 | 0.022 | 0.0045 | 0.0048 | 0.008 | 0.007 | 0.002 | 0.0010 | 2.79 | 786 | 791 |
| H | 0.65 | 1.5 | 0.8 | 0.9 | — | — | — | — | — | — | — | 0.0042 | 0.008 | 0.003 | 0.002 | 0.0015 | 0 | 763 | 788 |
| I | 0.65 | 1.9 | 0.9 | 0.6 | — | — | — | — | — | — | 0.0025 | 0.0038 | 0.010 | 0.012 | 0.003 | 0.0010 | −0.66 | 767 | 807 |
| J | 0.62 | 2.0 | 1.0 | 1.1 | 0.35 | 0.08 | — | — | — | 0.015 | 0.0025 | 0.0042 | 0.013 | 0.012 | 0.030 | 0.0005 | 14.44 | 772 | 808 |
| K | 0.61 | 1.4 | 0.6 | 1.5 | — | — | — | — | — | 0.022 | — | 0.0038 | 0.008 | 0.003 | 0.006 | 0.0004 | 0 | 778 | 793 |

$Ae_1$ point = 723 − 14[Mn] + 22[Si] − 14.4[Ni] + 23.3[Cr]
$Ae_3$ point = 854 − 180[C] − 14[Mn] + 44[Si] − 17.8[Ni] − 1.7[Cr]

TABLE 2

| Test No. | Steel grade | Cooling rate at casting [° C./sec] | Rolling condition: Placing temperature [° C.] | Cooling rate between placing temperature and 700° C. [° C./sec] | Cooling time between placing temperature and 850° C. [sec] | Patenting condition: Wire diameter [mm] | Heating temperature [° C.] | Heating retention time [sec] | Cooling rate [° C./sec] | Patenting time [sec] | Drawn wire diameter [mm] | Drawn wire total area reduction ratio [%] |
|---|---|---|---|---|---|---|---|---|---|---|---|---|
| A-1 | A | 0.12 | 925 | 15 | 3.5 | 8.4 | 950 | 45 | 4.1 | 180 | 4.0 | 77.3 |
| A-2 | A | 0.30 | 950 | 12 | 5.5 | 8.4 | 920 | 200 | 3.8 | 180 | 4.0 | 77.3 |
| A-3 | A | 0.55 | 980 | 13 | 6.0 | 8.4 | 955 | 40 | 2.8 | 850 | 4.0 | 77.3 |
| B-1 | B | 0.54 | 925 | 5 | 8.0 | 8.4 | 980 | 45 | 5.1 | 240 | 3.9 | 78.4 |
| B-2 | B | 0.15 | 950 | 20 | 3.5 | 8.4 | 930 | 210 | 4.5 | 250 | 3.9 | 78.4 |
| B-3 | B | 0.22 | 980 | 16 | 6.5 | 8.4 | 1000 | 45 | 1.8 | 560 | 3.9 | 78.4 |
| C-1 | C | 0.67 | 980 | 10 | 7.5 | 8.4 | 955 | 50 | 4.2 | 100 | 3.2 | 85.5 |
| C-2 | C | 0.75 | 1000 | 32 | 3.5 | 8.4 | 970 | 50 | 1.5 | 370 | 3.2 | 85.5 |
| D-1 | D | 0.50 | 900 | 10 | 3.0 | 8.4 | 980 | 60 | 5.8 | 1000 | 3.0 | 87.2 |
| D-2 | D | 0.33 | 950 | 15 | 4.5 | 8.4 | 950 | 50 | 2.5 | 1500 | 3.0 | 87.2 |
| E-1 | E | 0.11 | 930 | 10 | 5.0 | 8.4 | 950 | 50 | 3.3 | 850 | 2.9 | 88.1 |
| E-2 | E | 0.15 | 1000 | 18 | 6.0 | 8.4 | 980 | 45 | 2.8 | 970 | 2.9 | 88.1 |
| F-1 | F | 0.32 | 920 | 4 | 8.0 | 8.4 | 1000 | 35 | 5.2 | 1500 | 3.6 | 81.6 |
| F-2 | F | 0.44 | 950 | 10 | 8.0 | 8.4 | 930 | 25 | 5.0 | 1600 | 3.6 | 81.6 |
| G-1 | G | 0.54 | 980 | 12 | 8.0 | 8.4 | 1040 | 50 | 5.3 | 1250 | 3.5 | 82.6 |
| G-2 | G | 0.50 | 880 | 8 | 2.0 | 8.4 | 960 | 50 | 5.0 | 1300 | 3.5 | 82.6 |
| H-1 | H | 0.38 | 925 | 4 | 8.0 | 8.4 | 955 | 55 | 4.8 | 300 | 3.0 | 87.2 |
| I-1 | I | 0.33 | 910 | 2 | 10.0 | 8.4 | 955 | 60 | 5.1 | 300 | 3.5 | 82.6 |
| J-1 | J | 0.24 | 900 | 13 | 3.5 | 8.4 | 980 | 80 | 5.6 | 980 | 3.3 | 84.6 |
| K-1 | K | 0.50 | 960 | 18 | 5.0 | 8.4 | 960 | 80 | 5.8 | 540 | 3.4 | 83.6 |
| K-2 | K | 0.33 | 970 | 19 | 5.0 | 8.4 | 960 | 70 | 5.0 | 550 | 2.8 | 88.9 |

TABLE 3

| Test No. | Drawn wire tensile strength [MPa] | Total B amount [mass %] | Solid solute B amount [mass %] | Pearlite nodule grain boundary: Segregated B amount [mass %] | Segregated B amount/solid solute B amount | Torsion Number [time] | Ferrite fraction [area %] | Fatigue fracture ratio $1 \times 10^7$ times [%] | Judgment of fatigue characteristic | Expression (2): Lower limit | Upper limit |
|---|---|---|---|---|---|---|---|---|---|---|---|
| A-1 | 2160 | 0.0020 | 0.0012 | 0.11 | 92 | 28 | 0.3 | 0 | Acceptable | 1837 | 2238 |
| A-2 | 2055 | 0.0020 | 0.0002 | 0.03 | 150 | 15 | 1.3 | 12 | Unacceptable | 1837 | 2238 |
| A-3 | 2050 | 0.0020 | 0.0005 | 0.25 | 500 | 20 | 1.2 | 8 | Unacceptable | 1837 | 2238 |
| B-1 | 2040 | 0.0020 | 0.0015 | 0.21 | 140 | 27 | 0.8 | 0 | Acceptable | 1839 | 2240 |
| B-2 | 2050 | 0.0020 | 0.0004 | 0.01 | 25 | 15 | 1.4 | 5 | Unacceptable | 1839 | 2240 |
| B-3 | 1980 | 0.0020 | 0.0008 | 0.15 | 188 | 19 | 1.3 | 10 | Unacceptable | 1839 | 2240 |
| C-1 | 1980 | 0.0030 | 0.0022 | 0.11 | 50 | 26 | 0.4 | 0 | Acceptable | 1862 | 2262 |
| C-2 | 1900 | 0.0030 | 0.0011 | 0.07 | 64 | 20 | 1.8 | 8 | Unacceptable | 1862 | 2262 |
| D-1 | 2160 | 0.0020 | 0.0013 | 0.31 | 238 | 31 | 0.9 | 0 | Acceptable | 1873 | 2273 |
| D-2 | 2040 | 0.0020 | 0.0007 | 0.18 | 257 | 17 | 2.4 | 6 | Unacceptable | 1873 | 2273 |

TABLE 3-continued

| Test No. | Drawn wire tensile strength [MPa] | Total B amount [mass %] | Solid solute B amount [mass %] | Pearlite nodule grain boundary Segregated B amount [mass %] | Pearlite nodule grain boundary Segregated B amount/solid solute B amount | Torsion Number [time] | Ferrite fraction [area %] | Fatigue fracture ratio $1 \times 10^7$ times [%] | Judgment of fatigue characteristic | Expression (2) Lower limit | Expression (2) Upper limit |
|---|---|---|---|---|---|---|---|---|---|---|---|
| E-1 | 2100 | 0.0033 | 0.0024 | 0.21 | 88 | 27 | 0.4 | 0 | Acceptable | 1880 | 2280 |
| E-2 | 2010 | 0.0033 | 0.0018 | 0.12 | 67 | 10 | 1.9 | 10 | Unacceptable | 1880 | 2280 |
| F-1 | 2020 | 0.0010 | 0.0008 | 0.11 | 138 | 28 | 0.9 | 0 | Acceptable | 1846 | 2247 |
| F-2 | 2050 | 0.0010 | 0.0001 | 0.02 | 200 | 10 | 2.5 | 6 | Unacceptable | 1846 | 2247 |
| G-1 | 2005 | 0.0045 | 0.0033 | 0.05 | 15 | 25 | 0.8 | 0 | Acceptable | 1849 | 2250 |
| G-2 | 2045 | 0.0045 | 0.0004 | 0.03 | 75 | 18 | 3.5 | 10 | Unacceptable | 1849 | 2250 |
| H-1 | 2150 | 0 | 0 | 0 | 0 | 20 | 2.5 | 10 | Unacceptable | 1873 | 2273 |
| I-1 | 2210 | 0.0025 | 0.0004 | 0.01 | 25 | 18 | 5.6 | 14 | Unacceptable | 1849 | 2250 |
| J-1 | 2003 | 0.0025 | 0.0004 | 0.03 | 75 | 15 | 3.2 | 11 | Unacceptable | 1857 | 2257 |
| K-1 | 1995 | 0 | 0 | 0 | 0 | 10 | 1.2 | 6 | Unacceptable | 1853 | 2253 |
| K-2 | 2260 | 0 | 0 | 0 | 0 | 8 | 4.7 | 14 | Unacceptable | 1888 | 2288 |

From Table 3, it can be considered as follows.

Firstly, in each of the cases A-1, B-1, C-1, D-1, E-1, F-1, and G-1 satisfying the requirements of the present invention, the segregated B amount is 0.05% or more and hence the torsion number is 25 times or more and the wire drawability is excellent, and also the solid solute B amount is 0.0005% or more and hence the ferrite fraction is 1 area % or less, the fatigue breakage ratio is zero, and thus the fatigue characteristic is also excellent.

On the other hand, in the cases below wherein any one of the requirements stipulated in the present invention is not satisfied, both the wire drawability and the fatigue characteristic are inferior because of the reasons shown below.

A-2 and F-2 are the cases where the solid solute B amount is small and the ferrite fraction is large since the heating temperature is low at patenting treatment and, in the case of A-2 further, the heating retention time is long.

A-3, B-3, C-2, D-2, and E-2 are the cases where the ferrite fraction is large since the cooling rate is low at the patenting treatment.

B-2 is the case where the solid solute B amount and the segregated B amount are small, the ratio "segregated B amount/solid solute B amount" is low, and the ferrite fraction is large since the heating temperature is low at patenting treatment and the heating retention time is long.

G-2 is the case where the solid solute B amount and the segregated B amount are small and the ferrite fraction is large since the placing temperature after rolling is low.

H-1, K-1, and K-2 are the cases where the ferrite fraction is large since the steel grades H and K to which B is not added are used.

I-1 is the case where the solid solute B amount and the segregated B amount are small, the ratio "segregated B amount/solid solute B amount" is low, and the ferrite fraction is large since the expression (1) is not satisfied and the cooling rate between the placing temperature and 700° C. at the rolling is low.

J-1 is the case where the steel grade J containing a small amount of solid solute B as shown in Table 1 because the expression (1) is not satisfied is used and the ferrite fraction is large.

INDUSTRIAL APPLICABILITY

A spring steel wire according to the preset invention is excellent in fatigue characteristic and wire drawability and hence is preferably used for, for example, a spring steel wire for cold-winding formed into a steel spring by applying quenching and tempering treatment after wiredrawing and a spring steel wire for cold-winding formed into a steel spring as it is wiredrawn. The spring steel wire according to the preset invention is preferably used for, for example, a valve spring, a clutch spring, and a suspension spring used for an engine, a clutch, and a suspension.

The invention claimed is:

1. A spring steel wire excellent in fatigue characteristic and wire drawability wherein:

said spring steel wire contains

C: 0.50%-0.70%,

Si: 1.0%-2.5%,

Mn: 0.5%-1.5%,

Cr: 0.5%-1.5%,

Ti: 0.005%-0.10%,

B: 0.0010%-0.0050%,

N: 0.005% or less,

P: 0.015% or less,

S: 0.015% or less,

Al: 0.03% or less, and

O: 0.0015% or less;

wherein for each chemical component, % means mass %;

the contents (mass %) of B, Ti, and N satisfy the expression (1):

$$0.03 \leqq B/(Ti/3.43-N) \leqq 5.0 \quad (1);$$

the amount of solid solute B is in the range of 0.0005% to 0.0040%;

the remainder in said spring steel wire is composed of Fe and unavoidable impurities;

when the diameter of said steel wire is represented by D, the ferrite fraction at a position ¼ D in depth from the surface is 1 area % or less; and said solid solute B concentrates at the grain boundaries of pearlite nodules, and wherein the spring steel wire contains TiC.

2. The spring steel wire according to claim 1, wherein said spring steel wire further contains, as additional elements, at least one element selected from the group consisting of

V: 0.07%-0.4%,

Nb: 0.01%-0.1%,

Mo: 0.01%-0.5%,

Ni: 0.05%-0.8%, and

Cu: 0.01%-0.7%.

3. A spring excellent in fatigue characteristic wherein said spring is produced by using a spring steel wire according to claim 1.

4. A spring excellent in fatigue characteristics wherein said spring is produced by using a spring steel wire according to claim 2.

5. The spring steel wire according to claim 1, wherein the C content is 0.5 to 0.65%.

6. The spring steel wire according to claim 1, wherein the C content is 0.6 to 0.65%.

7. The spring steel wire according to claim 1, wherein he Si content is 1.6% to 2.2%.

8. The spring steel wire according to claim 1, wherein the Mn content is 0.70% to 1.0%.

9. The spring steel wire according to claim 1, which contains TiN.

10. The spring steel wire according to claim 1, which contains 0.01% to 0.10% of Ti.

11. The spring steel wire according to claim 1, which contains 0.002% to 0.0040% of B and 0.001% to 0.0030% of solid solute B.

12. The spring steel wire according to claim 1, wherein the contents in mass % of B, Ti, and N satisfy the following relationship:

$$0.1 \leqq B/(Ti/3.43-N) \leqq 4.0.$$

13. The spring steel wire according to claim 1, wherein the contents in mass % of B, Ti, and N satisfy the following relationship:

$$0.2 \leqq B/(Ti/3.43-N) \leqq 2.5.$$

14. The spring steel wire according to claim 1, which contains 0.02% to 0.05% of Nb.

15. The spring steel wire according to claim 1, which is produced by a process which comprises patenting at a temperature of 950° C. to 1050° C.

* * * * *